US005346094A

United States Patent [19]

Strawser

[11] Patent Number: 5,346,094

[45] Date of Patent: Sep. 13, 1994

[54] FULLY PUMPABLE DRUM BOTTOM

[75] Inventor: Harry L. Strawser, Maineville, Ohio

[73] Assignee: Astro Containers, Inc.

[21] Appl. No.: 61,423

[22] Filed: Feb. 12, 1993

[51] Int. Cl.[5] ..... B65D 81/36

[52] U.S. Cl. ..... 220/571; 220/608; 220/DIG. 6

[58] Field of Search ..... 220/571, 573, 608, DIG. 6

[56] References Cited

U.S. PATENT DOCUMENTS

D. 112,636 12/1938 Goll et al. .
D. 227,079 6/1973 Lustig .
D. 238,333 1/1976 Seddon .
D. 289,937 5/1987 Cleveland, Jr. .
1,161,727 11/1915 Randall ..... 220/571
3,129,730 4/1964 Simon .
3,143,238 8/1964 Bulgrin .
3,170,586 2/1965 Bulgrin .
3,434,626 3/1969 Kinslow, Jr. .
4,054,219 10/1977 Young et al. .
4,651,887 3/1987 Patrick ..... 220/573
4,690,299 9/1987 Cannon .
4,802,599 2/1989 Hill ..... 220/573
5,047,271 9/1991 Feddersen et al. ..... 220/608
5,071,015 12/1991 Kinslow ..... 220/608

*Primary Examiner*—Joseph Man-Fu Moy
*Attorney, Agent, or Firm*—Dinsmore & Shohl

[57] ABSTRACT

An improved drum bottom for facilitating the emptying of drum containers. This invention allows for increased removal of drum contents. This drum bottom employs a sloped channel for drainage of the contents of the drum into a well for removal by a pump.

6 Claims, 3 Drawing Sheets

FULLY PUMPABLE DRUM BOTTOM

BACKGROUND OF THE INVENTION

I. Field of the Invention

Drums are containers used to store and transport many different types of contents. Drums can be constructed of one of many types of material. Generally though, drums are made of metal. Typical drum sizes are 30 gallon and 55 gallon. Due to stresses imposed on the drums, either externally during transport and storage or internally from pressurized contents or heavy contents, drums need to be rigid and strong. Typical types of materials that are stored in drums include: oil, starches, glues, paints, ethylene glycols, fatty acids, flavorings and essential oils. Drum bottoms require strength as well as stability for standing upright.

A common problem in the drum art is that drum contents always remains in the bottom of the container. The inability to recover all of the drum contents results in wasted product and increased costs as well as possible toxic problems or spoilage problems. In addition, drums are often reused, but because they cannot be easily and fully emptied, the drums require complete emptying and then cleaning in order for reuse. There is a need in the container related art for an improved drum bottom that provides increased recovery of drum contents and thus, a drum bottom that is more efficient and economical.

The present invention relates to containers or drums and is directed particularly to a type of drum bottom. This field of art is always looking for ways to recover more contents from a drum container. The present invention relates to an improved drum bottom. The improvement comprises a sloped channel through which the contents drains and collects in a depression. The depression accommodates a pump mechanism, the tube of which extends beneath the surface of the collected contents in the depression, thus allowing an increased amount of the drum contents to be removed from the container than previously possible. In addition, this improved drum bottom is of sufficient strength and rigidity to withstand the pressures commonly applied to drum bottoms.

II. Related Art

Bulgrin, U.S. Pat. No. 3,170,586, discloses a single walled metal container including a bottom end shell having a spherical domed surface. The bottom end shell implements an embossed sump extending from the center point radially outward and increases in size as it approaches the integral double walled chime. The Bulgrin Patent discloses a domed surface in conjunction with an integral double walled chime and sump configuration in order to provide the opportunity to use fittings for either the bottom or the side of the bottom end shell.

The primary object of the present invention is to drain the contents of the drum to a depression in the bottom of a container where a pump removes almost all of the contents. The present invention discloses a sloped surface, whereas Bulgrin shows a spherical domed surface. The contents of the Bulgrin container are under pressure in order to facilitate emptying, whereas the present invention employs a pump in the recess of the drum bottom for removal of the contents. While the present invention can contain pressurized contents, pressure is not a necessary element for removal of the contents.

Simon, U.S. Pat. No. 3,129,730, discloses a beer keg having a diametrically sloping depression in the bottom wall into which a discharge pipe of a pump extends to remove the contents. The Simon bottom head contains a diametrically sloped, centrally located depression, whereas the present drum bottom invention contains a sloped channel and a depression located several inches from the centerpoint. While the depression in the Simon bottom wall may collect some of the remaining contents of the container, it has a trough around the circumference of the bottom wall at a point lower than the diametrically sloping depression into which the discharge pipe of the pump extends. Therefore, a significant amount of liquid will collect in the trough rather than in the sump for removal by the pump. Although the present invention also has a trough at the outer rim, it retains only a few milliliters of contents. In addition, the drainage channel directs the flow of the contents past the central and rim sections for recovery of an increased amount over the Simon bottom head.

Bulgrin, U.S. Pat. No. 3,143,238, discloses a single wall metal container having a smooth concaved interior surface and a convexed exterior surface. The surfaces are bounded by an axially tapered annular flange. The center of the end shell contains a spherical embossment that projects axially outwardly of the exterior surface. The embossment provides for increased drainage from extending the tube into it. The entire bottom of the Bulgrin container is smooth and concave and contains a centrally located spherical embossment for collecting the remaining liquid. This Bulgrin container does not employ either the sloping channel, the sloping bottom or the off-center depression of the present invention.

The related art does not show the unique combination of the sloped channel and the depression of the present container bottom which is designed to provide for maximum removal of the container's contents. In fact, the present invention provides about a 2% or about a one gallon increase in the amount of drum contents that can be removed from a 55 gallon sized drum, or, about a 2.5% or a three-quarters gallon increase in the amount of drum contents that can be removed from a 30 gallon drum over the drum bottoms currently used in industry.

Brief Summary of the Invention

Accordingly, it is the primary object of this invention to provide a novel drum bottom.

It is a particular object of this invention to provide a drum bottom with improved efficiency by removing more of the contents of a drum than previously possible and leaving hardly any contents in the bottom of the drum.

It is a more particular object of this invention to provide a drum bottom which channels the contents of the drum into a depression in the bottom of the container so that a pump can remove an increased amount of the contents.

It is an additional object of this invention to provide a drum bottom employing a sloped channel which directs the flow of contents into a depression located 60–80% of the distance radially from the centerpoint.

It is another object of this invention to permit the down tube of a pump to extend into the depression for more efficient removal of contents.

It is a further object of this invention to provide a fully pumpable drum bottom that is economically advantageous due to increased recovery of contents.

It is yet another object of this invention to provide a drum bottom that reduces costs associated with waste and cleaning.

In accordance with the invention, a drum bottom is constructed that has a sloped channel leading into a depression for collection of the remaining contents to be pumped out of the drum.

The above will become more apparent to those skilled in the art after a consideration of the following detailed description taken together with the accompanying drawings in which a preferred embodiment of the invention is described.

BRIEF DESCRIPTION OF THE DRAWINGS

FIG. 4 shows the direction of flow of the drum contents as it empties.

DETAILED DESCRIPTION OF THE PREFERRED EMBODIMENT

Figure 1:
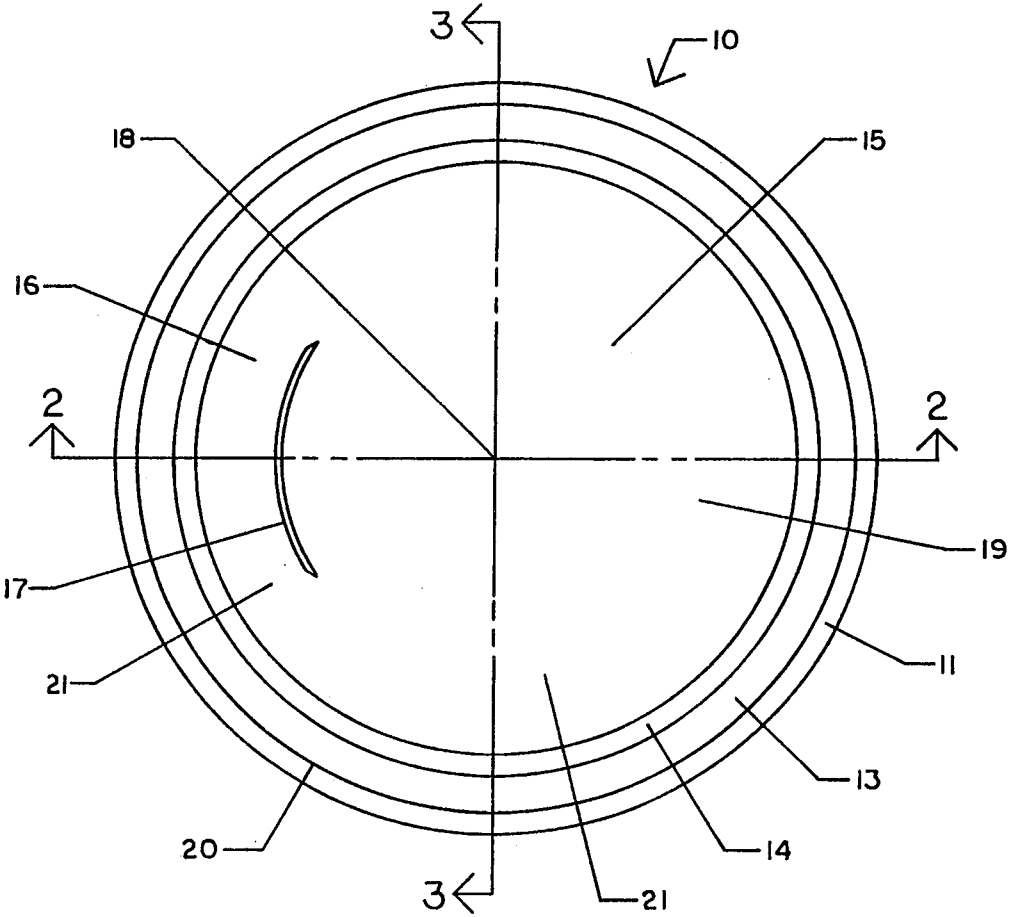
FIG. 1 is a top plan view of a drum bottom.

The drum bottom of the present invention comprises a tapered or sloped channel leading into a flat area constituting a depression or a well that is located 60–80% of the distance radially from the centerpoint of the bottom. As the drum container empties, the remaining contents flows through the sloped channel and collects in the well for removal by a pump that extends into the well. As a result, more of the contents of the drum is removed than from the containers described in the prior art. The present invention permits the maximum amount of drum contents to be pumped out of the container so that hardly any contents remains in the container. The drum bottom is designed for rapid manufacture and cost effectiveness by stamping from a die cast.

Referring now to the drawings, the drum bottom is generally designated by reference numeral (10). There are three primary sections of the drum bottom (10): a central section (15) having a raised centerpoint (18), a sloping channel section (21) comprised of a depression (16) and a drainage channel (19), and a rim section (20). Generally, area (15) is raised at its centerpoint (18) such that contents flow radially away from the centerpoint (18) towards the sloping channel (21). The drainage channel (19) is tapered such that the contents flow toward the depression (16) where the contents collect.

Figure 2:
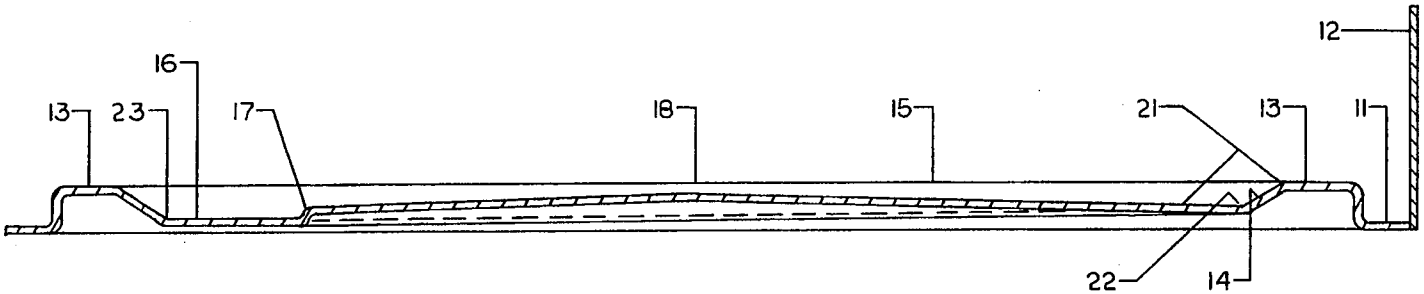
FIG. 2 is a cross sectional view along line 2—2 of FIG. 1.
Figure 3:
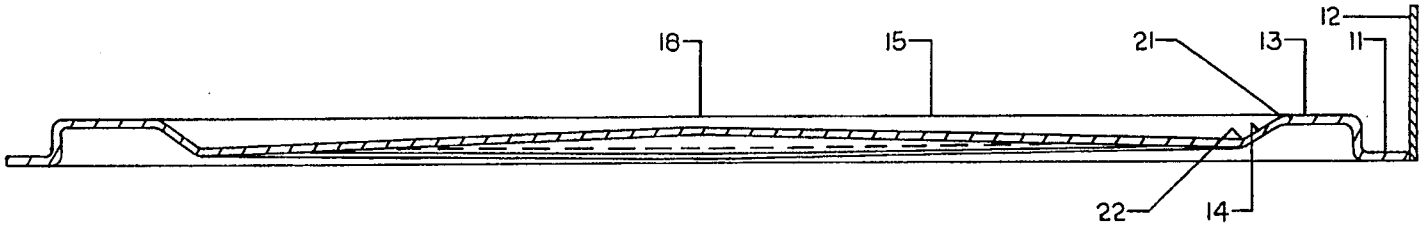
FIG. 3 is a cross sectional view along line 3—3 of FIG. 1.

The rim section (20) has an outermost trough (11) which circumscribes the entire drum bottom (10). The trough (11) is flat for stabilizing the drum in an upright position. FIG. 2 shows the attachment of the drum wall (12) to the drum bottom trough (11). Bordering trough (11) is a raised flat ridge (13) that circumscribes the entire drum bottom (10) on the interior side of trough (11). The raised flat ridge (13) has the highest elevation of the drum bottom (10), and the ridge (13) consistently maintains that height for the entire circumference of the bottom (10).

Referring now to FIG. 2, adjacent to ridge (13) is the sloping channel section (21) having a downward sloping wall (14) of varying steepness depending on location relative to the depression (16). The central section (15) at point (22) tapers down toward point (23) in the depression (16), therefore the slope required of wall (14) to connect ridge (13) to the drainage channel (19) is less than that required to connect ridge (13) to the depression (16).

The depression (16) is bordered on the rim side by sloping portion (14) and on the side nearer to center by sloping portion (17) so that the drum contents is contained in this area. Downward sloping portion (17) circumscribes approximately one-fourth to one-third of the interior of the drum bottom (10). The contents collects in the depression (16) because the drainage channel (19) is tapered in a downwardly direction towards the depression (16). The down tube of a pump fits into depression (16) for removal of the collected contents from the drum bottom.

Figure 4:
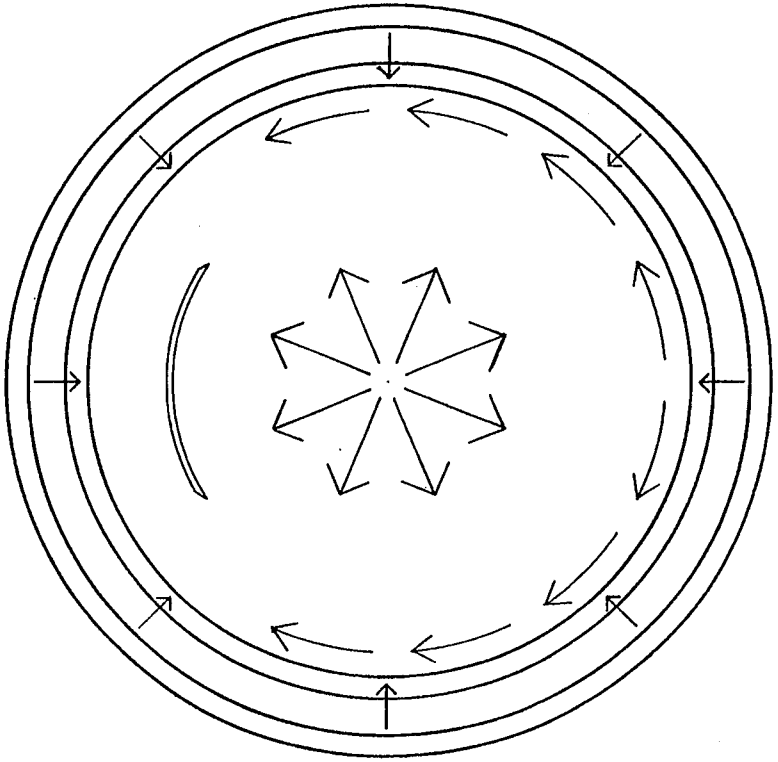
FIG. 4 is the same top plan view as in FIG. 1, however.

Referring to FIG. 4, there is shown the flow pattern that is created by the above described drum bottom. All contents are directed past the rim section (20) and the central section (15) and into the depression (16) either directly or via the drainage channel (19).

What is claimed is:

1. An improved drum bottom for facilitating the evacuation of contents, comprising:

a drum bottom, including a raised centerpoint from which contents flow outwardly into a sloping channel, said sloping channel extending circumferentially about the periphery of the drum bottom and tapering in a downwardly direction towards a depression extending about a circumferentially limited area of the drum bottom for holding and collecting the contents, said depression being a lowest point in a limited circumferential portion of said loping channel, whereby substantially all of the residual fluid in a drum is collected in the depression as the drum contents are emptied.

2. An improved drum bottom for facilitating the evacuation of contents, comprising:

a central section;

a rim section surrounding the central section; and a sloped channel section positioned between the central section and the rim section;

the central section having an inclined surface from its raised centerpoint which directs flow of contents toward the sloped channel section;

the rim section having generally flat raised portions extending to a higher elevation than the raised centerpoint of said central section and flat trough portions positioned outside said flat raised portions for stability and strength when standing upright;

the sloped channel section having a depression in communication with a drainage channel;

said depression extending approximately one-quarter to one-third the circumference of said sloping channel, and having slanted walls for connecting the central section and the rim section, said depression is adjacent to and in flow communication with the drainage channel;

said drainage channel having the lowest point from the centerpoint to the rim, and is adjacent the rim, and gradually tapers in a downwardly direction to said depression for directing the flow of the contents from the central section and the rim section into said depression.

3. An improved drum bottom for facilitating the evacuation of contents as recited in claim 2, wherein the rim section comprises one raised rim portion and one flat trough rim portion.

4. An improved drum bottom for facilitating the evacuation of contents as recited in claim 2, wherein said depression spans an angle of said drum bottom in the range of 90° to 120°.

5. An improved drum bottom for facilitating the evacuation of contents as recited in claim 2, wherein the angle of incline of said slanted wall from said depression to said rim is in the range of 40° to 55°, from said depression to said central portion is in the range of 45° to 60°, and from said drainage channel to said rim is in the range of 20° to 40°.

6. An improved drum bottom for facilitating the evacuation of contents as recited in claim 2, wherein said depression is in association with a discharge pipe of a pump to promote emptying of the drum.

* * * * *

UNITED STATES PATENT AND TRADEMARK OFFICE

CERTIFICATE OF CORRECTION

PATENT NO. : 5,346,094

DATED : September 13, 1994

INVENTOR(S) : Harry L. Strawser

It is certified that error appears in the above-identified patent and that said Letters Patent is hereby corrected as shown below:

Column 4:

Claim 1, line 31, "loping" should be -- sloping --.

Signed and Sealed this

Twenty-second Day of November, 1994

*Attest:*

*Attesting Officer*

BRUCE LEHMAN

*Commissioner of Patents and Trademarks*